US006971770B2

(12) United States Patent
Rasmussen et al.

(10) Patent No.: US 6,971,770 B2
(45) Date of Patent: Dec. 6, 2005

(54) LIGHTING APPARATUS

(75) Inventors: Niels Jorgen Rasmussen, Arhus (DK); Mads Glavind, Hobro (DK)

(73) Assignee: Martin Professional A/S, (DK)

( * ) Notice: Subject to any disclaimer, the term of this patent is extended or adjusted under 35 U.S.C. 154(b) by 182 days.

(21) Appl. No.: 10/236,606

(22) Filed: Sep. 6, 2002

(65) Prior Publication Data

US 2003/0076681 A1 Apr. 24, 2003

Related U.S. Application Data

(60) Provisional application No. 60/317,629, filed on Sep. 6, 2001.

(51) Int. Cl.[7] ..... F21V 9/00

(52) U.S. Cl. ..... 362/293; 362/283; 362/284; 362/323; 362/324; 362/811

(58) Field of Search ..... 362/293, 282, 362/283, 284, 322, 323, 324, 806, 811; 353/62, 353/80, 120

(56) References Cited

U.S. PATENT DOCUMENTS 5,934,794 A * 8/1999 Hutton ..... 362/323
6,113,252 A * 9/2000 Arlitt et al. ..... 362/283

* cited by examiner

*Primary Examiner*—Stephen F Husar
(74) *Attorney, Agent, or Firm*—Skadden, Arps, Slate, Meagher & Flom LLP

(57) ABSTRACT

Lighting apparatus includes an effect wheel which is mounted on a rotation mechanism. The rotation mechanism is mounted on a mechanism which moves the effect wheel from a position outside of the light path to a position in which the effect wheel intersects the light path to provide a continuous wheel effect. The translation mechanism can move the effect wheel between positions in which the effect wheel crosses the light path in a horizontal direction and in a vertical direction, respectively. The apparatus allows a continuous wheel effect to be added to a multi-purpose luminaire and also allows the direction of travel of the continuous wheel effect across the illuminated field to be continuously varied.

14 Claims, 6 Drawing Sheets

LIGHTING APPARATUS

CROSS-REFERENCE TO RELATED APPLICATIONS

This application claims priority to U.S. Provisional Application Ser. No. 60,317,629, filed on Sep. 6, 2001.

FIELD OF THE INVENTION

The present invention relates to lighting apparatus and in particular to lighting apparatus for providing a continuous wheel effect.

BACKGROUND OF THE INVENTION

Theatrical lighting fixtures (or "luminaires") are used in theatres, nightclubs, concerts and the like to produce a wide variety of visual effects. An example of a multi-parameter lighting fixture is described in U.S. Pat. No. 4,392,187 to Bornhorst.

One type of effect is a continuous wheel effect, which is used in theatrical lighting to give animated visual effects reminiscent of, for example, passing clouds or flames. Traditionally, such an effect is produced by placing an appropriate rotating mask in front of a lamp with the center of the rotating mask outside of the beam of the lamp. A continuous wheel effect tends to be relatively static, apart from the rotation of the mask.

In general, the lighting apparatus may be in the form of a component for insertion into a luminaire, or other lighting fixture. The invention extends, therefore, to a luminaire comprising the lighting apparatus of the invention. The luminaire generally includes a light source, such as for example, a discharge lamp. The luminaire includes optical components, such as an elliptical reflector, arranged to direct light from a light source along the light path to the plane of the effect wheel. The luminaire includes one or more lenses, prisms, shutters and/or apertures arranged to direct light from the plane of the effect wheel out of the luminaire. The lighting apparatus may also include additional optical effects, such as gobos, color filters, prisms and the like.

SUMMARY OF THE INVENTION

Viewed from a first aspect, the invention provides lighting apparatus having a light path defined therethrough, comprising an effect wheel having a center and an effect region located radially outwardly of the center, the effect region being configured to alter the visual appearance of a light beam passing therethrough. The apparatus also includes a rotation mechanism arranged to rotate the effect wheel about the center. Finally, the apparatus includes a translation mechanism arranged to move the effect wheel between a first position in which the effect region is outside of the light path, and a second position in which the effect region intersects the light path and in which the center of the effect wheel is outside the light path.

Viewed from a further aspect, the invention provides a removable optical component for a lighting fixture including an optical portion adapted to alter the visual appearance of a light beam passing therethrough, a magnetic portion arranged to attach the optical component to a surface of a lighting fixture by magnetic attraction, and at least one locating formation configured to engage with a complementary locating formation on said lighting fixture to locate the optical component in position on said fixture.

Thus, according to this aspect of the invention, any optical component of a lighting fixture, such as a gobo, effect wheel, color filter or the like, can be attached easily in position by magnetic attraction.

In one embodiment, the complementary locating formations are mating pairs such as a projection and a complementary hole or recess, a rim and complementary ring, or any other suitable arrangement. The mating pairs are preferably arranged to prevent translational and/or rotational movement of the optical component relative to the lighting fixture. The invention also extends to a lighting fixture comprising such an optical component.

DETAILED DESCRIPTION OF THE INVENTION

Figure 1:
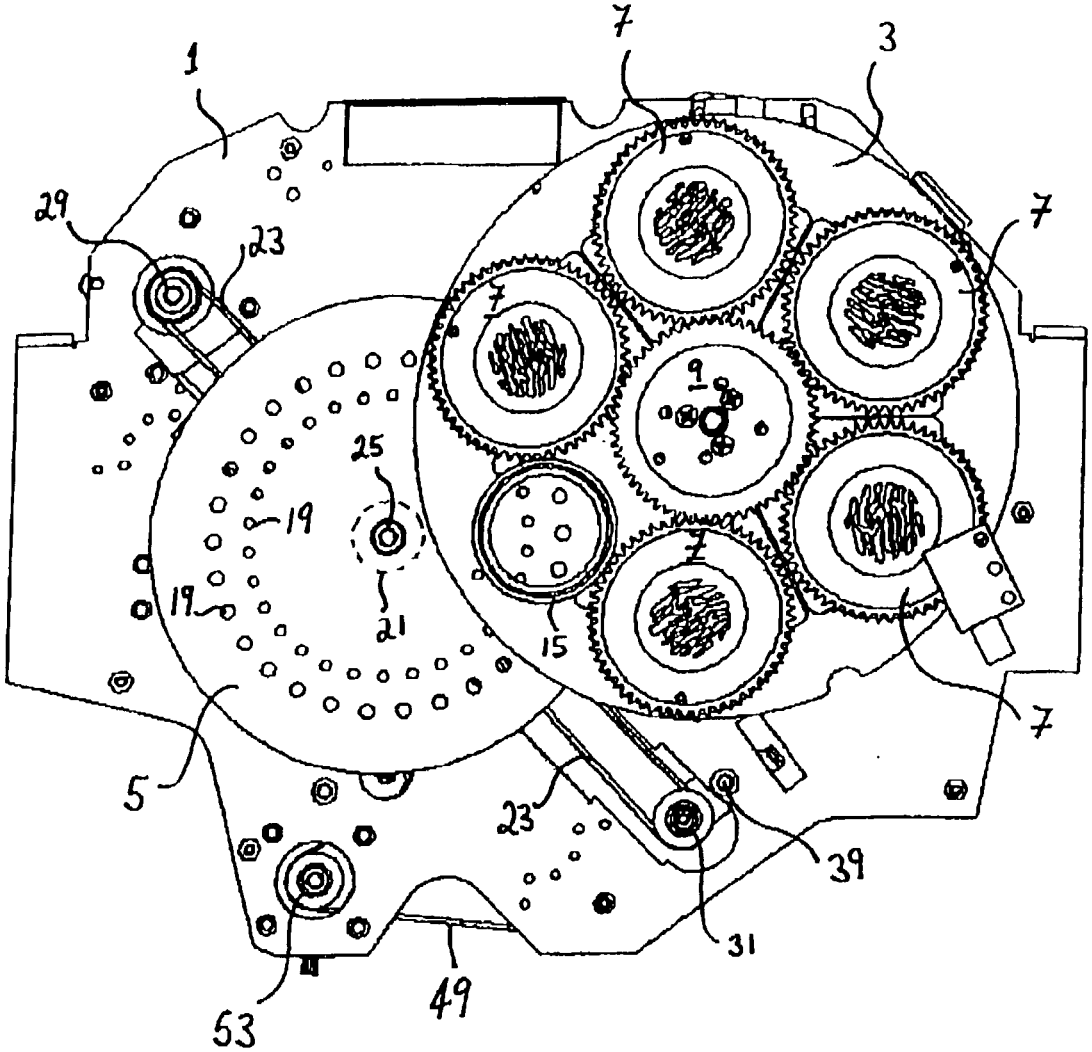
FIG. 1 is a front view of an embodiment of the invention.

FIG. 1 shows lighting apparatus according to an exemplary embodiment of the invention comprising a chassis 1 for mounting in a luminaire or other lighting fixture. Mounted to the chassis are a gobo wheel 3 and an effect wheel 5. The gobo wheel 3 includes five removably mounted gobos 7. Each gobo 7 has a toothed perimeter which engages with a central gobo drive wheel 9. The gobo drive wheel 9 is rotated by a gobo drive wheel motor 11 (see FIG. 2) to rotate each of the gobos 7. A gobo wheel motor 13 (see FIG. 2) is arranged to rotate the gobo wheel 3 by means of a belt (not shown) to align any selected gobo 7 with the light path of the luminaire.

The gobo wheel 3 includes a non-gobo aperture 15, which allows light to pass unaffected through the gobo wheel 3. In the position shown in FIG. 1, the non-gobo aperture 15 of the gobo wheel 3 is aligned with the light path of the luminaire. A corresponding aperture 17 (see FIG. 2 and FIG. 10) is defined in the chassis 1 to allow the passage of light from the light source of the luminaire.

Figure 6:
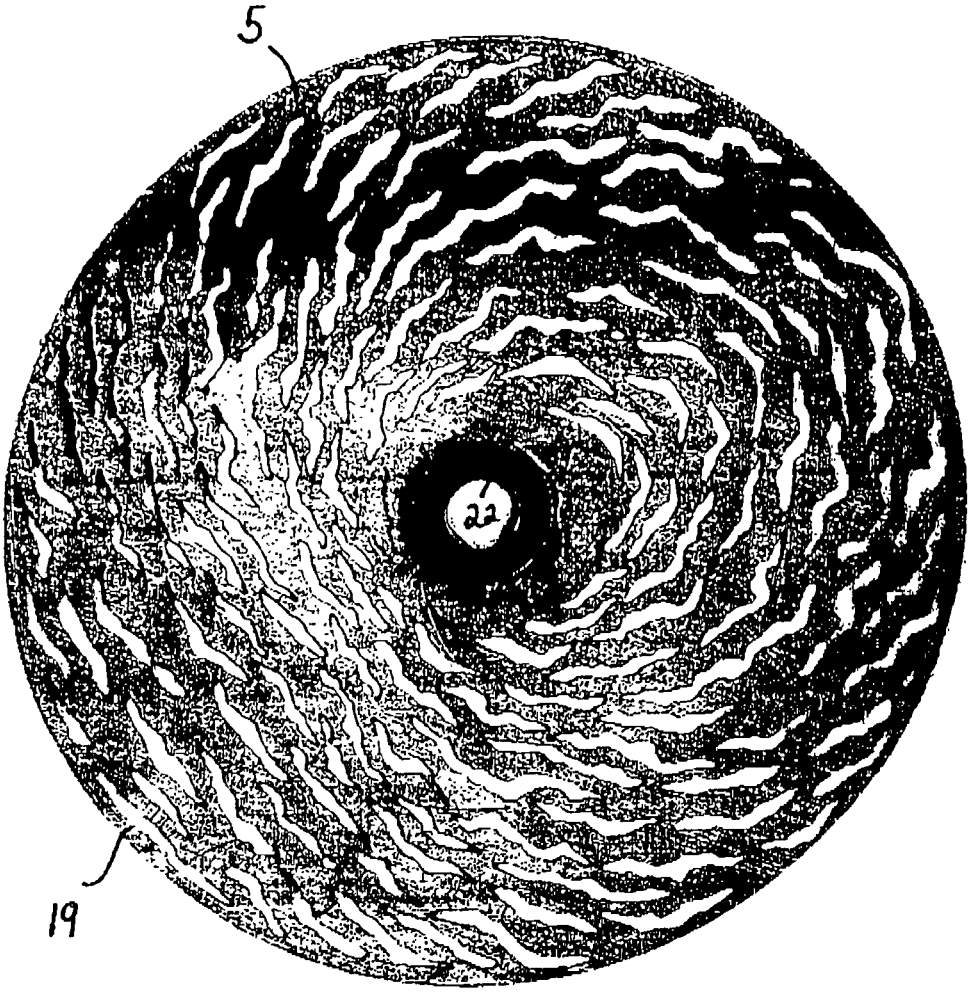
FIG. 6 shows an alternative effect wheel for use with the embodiment of FIG. 1.
Figure 9:
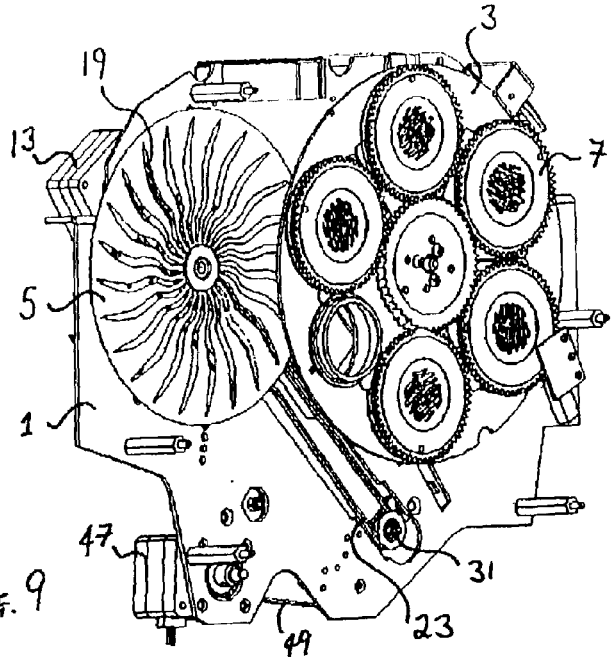
FIG. 9 is a perspective view of the embodiment of FIG. 1 in the position of FIG. 5 and with a further alternative effect wheel.
Figure 10:
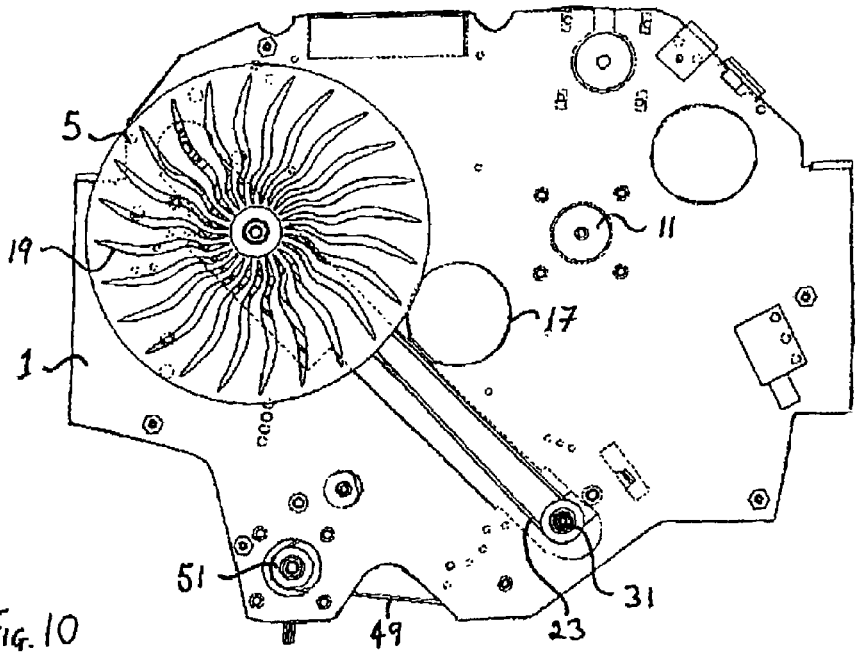
FIG. 10 is a front view of the embodiment of FIG. 1 in the position of FIG. 5 with the gobo wheel removed and with the further alternative effect wheel.

The effect wheel 5 illustrated in FIG. 1 is an aluminum disc perforated with a circular pattern of holes 19. The pattern of holes 19 shown on the effect wheel 5 in FIG. 1 is only one example of many such patterns which can be applied to effect wheels in accordance with the invention. An effect wheel 5 can be selected in accordance with the invention to provide projection effects which represent flame, clouds and other similar theatrical effects. Exemplary alternative effect wheels are shown in FIG. 6 and FIGS. 9 and 10.

In one embodiment, the lighting apparatus includes a chassis, for example in the form of a plate, to which the effect wheel, the rotation mechanism and/or the translation mechanism is mounted. The chassis can include an aperture which controls, at least partially, the light path through the apparatus. The plane of the effect wheel is preferably substantially perpendicular to the light path, at least when the effect wheel is in the second position. In this way, uniform focus of the effect wheel can be achieved.

In general, the effect wheel is circular, for example, in the form of a disc. However, in other embodiments, the effect wheel has other regular or irregular shapes. For example, the effect wheel can be square, hexagonal, or any other polygonal shape. Alternatively, the effect wheel can be star-shaped, flower-shaped, cloud-shaped, or take the form of a spoked wheel. In yet another embodiment, the effect wheel is an oil wheel comprising one or more liquids, such as oil, sealed between two transparent plates, or discs. As may be appreciated, the configuration of the effect wheel is determined predominantly by the visual effect that it is desired to produce.

In one embodiment, the effect wheel is substantially flat and of substantially constant thickness over its extent. However, in other embodiments the effect wheel is contoured, as required to produce a desired visual effect. Similarly, the thickness of the effect wheel can vary over its extent. For example, the effect region may be composed of transparent material and the desired visual effect is achieved by variations in the thickness of the material.

In one arrangement, the effect wheel is in the form of a disc of glass or other transparent material having a reflective, for example dichroic, coating thereon. In this embodiment, the coating is etched away to define a desired pattern.

The center of the effect wheel is the point about which the effect wheel is rotated by the rotation mechanism. The center is preferably substantially the center of mass or the centroid of the effect wheel. Alternatively, the center can be spaced from the geometrical center of the effect wheel, particularly where the shape of the effect wheel is irregular. The center preferably includes a mounting location for the effect wheel to the rotation mechanism. Alternatively, the center can simply be a notional point where the axis of rotation of the effect wheel intersects the plane of the effect wheel.

In one embodiment, the effect region may extend over substantially the entire surface of the effect wheel. Alternatively, the effect region is in the form of a ring of sufficient width to cover the light path when the effect wheel is in the second position. In some embodiments, the effect region may have an angular extent of less than 360 degrees about the center of the effect wheel, for example where a cyclical visual effect is desired. The composition of the effect region is determined predominantly by the visual effect to be produced. In a simple embodiment, the effect region is in the form a mask (or gobo) having holes defined therein to allow light to pass through in a predetermined pattern. Rotating masks of this type for providing a continuous wheel effect, for example to give the impression of clouds or fire are well known in theatrical lighting. The effect region may include, alternatively or in addition to masking, color filters, frosting, prisms or any other desired optical effect.

The size of the effect wheel and/or the effect region relative to the cross-sectional area of the light path is preferably sufficiently large so that the projected effect gives an impression that the effect region is crossing the light path in a substantially linear, rather than circular, path. Thus, in the second position, the distance between the center of the effect wheel and the center of the light path is desirably greater than half the maximum cross-sectional width of the light path. In another embodiment, this distance is greater than the maximum cross-sectional width of the light path. In yet another embodiment, this distance is greater than one and a half times the maximum cross-sectional width of the light path.

Hence, in this embodiment, the width (diameter) of the effect wheel is at least twice the maximum cross-sectional width of the light path. In other embodiments, the width (diameter) of the effect wheel increases to at least three or four times the maximum cross-sectional width of the light path.

The apparatus of the invention can be used to provide a continuous wheel effect, for example to give the impression of clouds or fire in theatrical lighting, when the effect wheel is in the second position. However, the effect wheel can be moved into the first position when the continuous wheel effect is not required so that the luminaire, or other lighting fixture in which the apparatus may be mounted, can additionally be used for other lighting effects.

The luminaire preferably includes a light source such as, for example a discharge lamp. The luminaire also includes optical components, such as an elliptical reflector, arranged to direct light from a light source along the light path to the plane of the effect wheel. The luminaire further includes one or more lenses, prisms, shutters and/or apertures arranged to direct light from the plane of the effect wheel out of the luminaire. Optionally, the lighting apparatus may comprise additional optical effects, such as gobos, color filters, prisms and the like.

Figure 7:
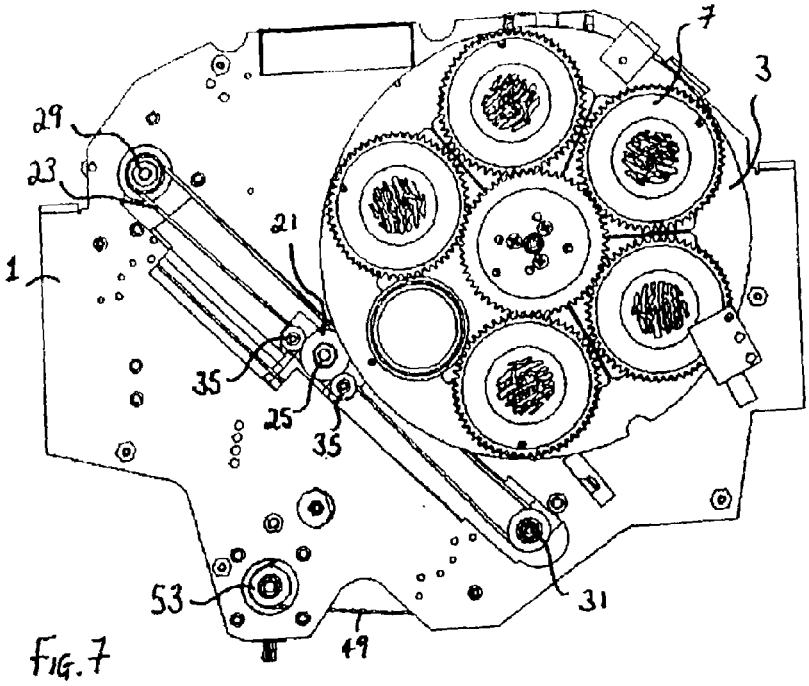
FIG. 7 is a front view of the embodiment of FIG. 1 with the effect wheel removed.
Figure 8:
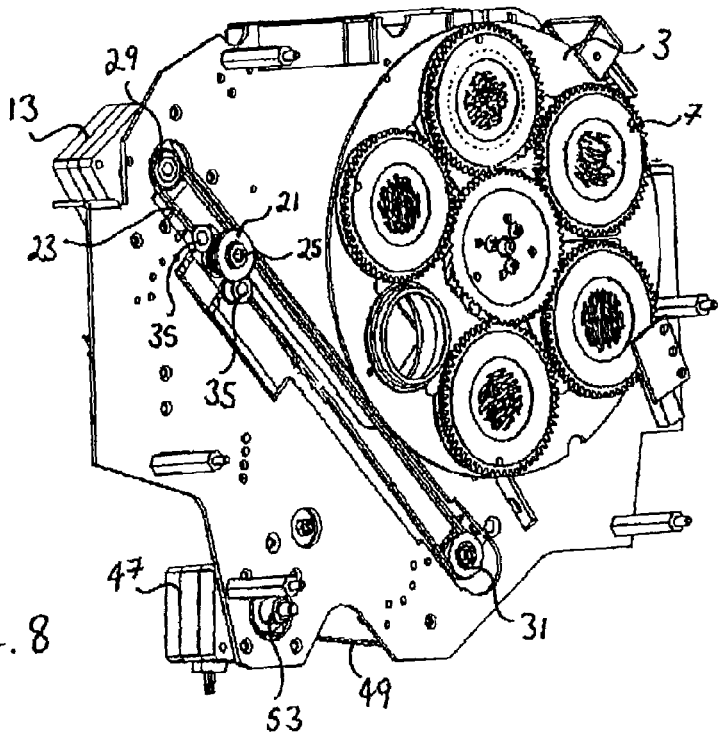
FIG. 8 is a perspective view of the embodiment of FIG. 1 in the position of FIG. 5 and with the effect wheel removed.

The effect wheel 5 is mounted on a drive disc 21 (see FIGS. 7 and 8) which is rotated by means of a first belt 23 as described in detail below. The effect wheel 5 is fixed to the drive disc 21 by means of a washer 22 of magnetic material which is bonded to the effect wheel 5 about its center (see FIG. 6). The washer 22 holds the effect wheel 5 to the ferrous drive disc 21 by magnetic attraction. The provision of a magnetic washer 22 allows for simple and rapid interchange of effect wheels 5. The effect wheel 5 is located centrally on the drive disk 21 by a central protuberance 25 which passes through a complementary aperture in the effect wheel.

Figure 2:
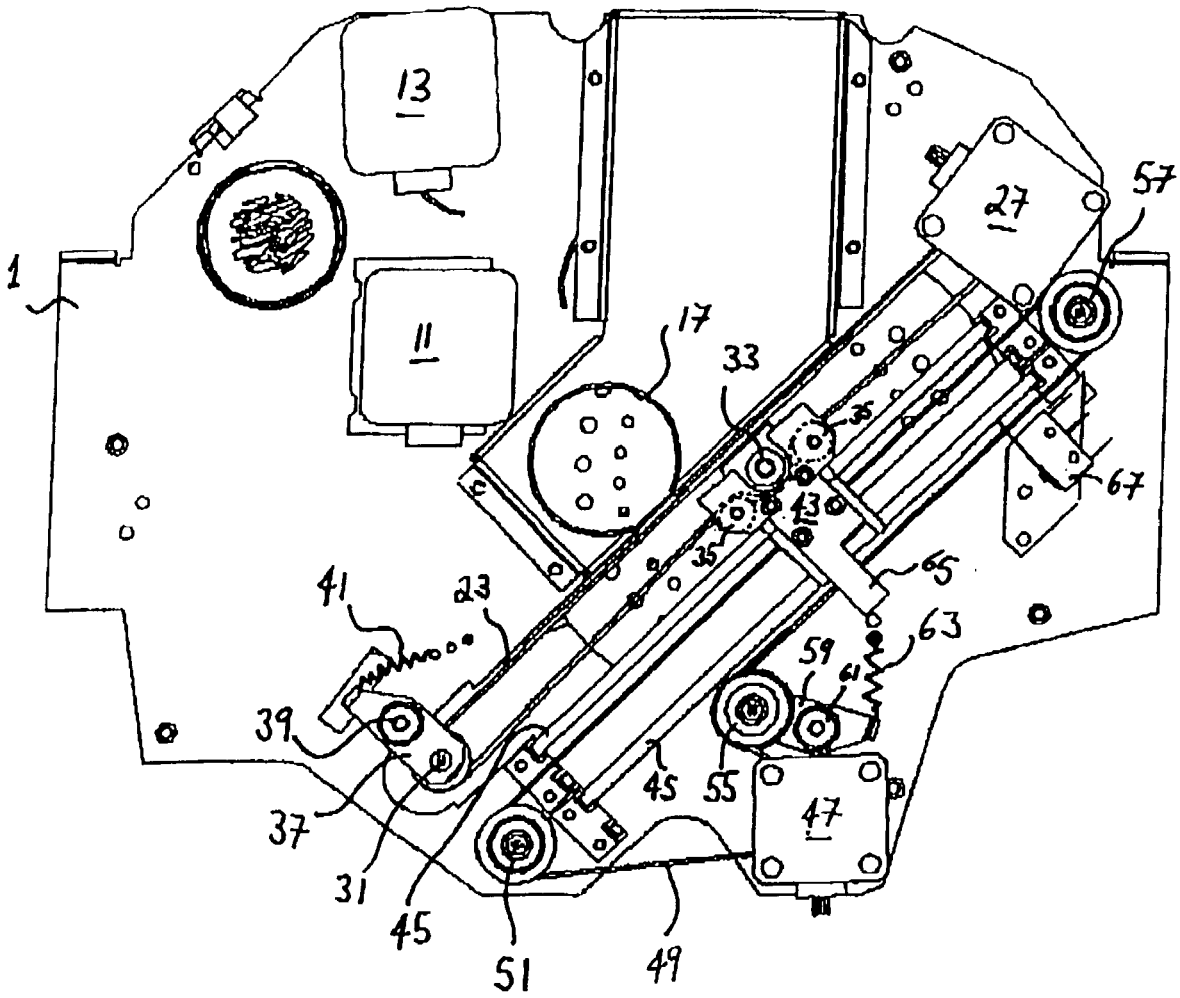
FIG. 2 is a rear view of the embodiment of FIG. 1.

Referring now to FIG. 2, the first belt 23 is driven by a rotation motor 27. The first belt 23 passes around a first drive pulley 29 (see FIG. 1), around a first tensioning pulley 31 and past a drive shaft 33 of the drive disc 21. The first belt 23 is a toothed belt which is keyed to the first drive pulley 29 and to the drive shaft 33. The first belt 23 is held against the drive shaft 33 by two guide rollers 35 (see FIGS. 7 and 8). The first tensioning pulley 31 is located at a distal end of a first tensioning arm 37 which is arranged to pivot about a first pivot 39. The first belt 23 is tensioned by the action of a first tension spring 41 which is connected between a proximal end of the first tensioning arm 37 and the chassis 1.

In operation, when the rotation motor 27 is activated, the rotation of the first drive pulley 29 is transmitted by the first belt 23 to rotate the drive shaft 33, the drive disc 21 and thus the effect wheel 5. The drive disc 21, drive shaft 33 and guide rollers 35 are all mounted on a carriage 43, which itself is slidably mounted on two parallel guide bars 45. The guide bars 45 confine the carriage 43 to move along a linear path at an angle of about 45° to the horizontal (or vertical) and parallel to the plane of the chassis 1. Consequently, the center of the effect wheel 5 is also moved along a parallel path.

The carriage 43 is driven along the guide bars 45 by a position motor 47 via a second belt 49. The second belt 49 is clamped within the carriage 43. The second belt 49 passes from the carriage 43 around a first free pulley 51, a second drive pulley 53 driven by the position motor 47, a second tensioning pulley 55, and around a second free pulley 57 back to the carriage 43. The second belt 49 is a toothed belt which is keyed to the second drive pulley 53. The second tensioning pulley 55 is mounted at the distal end of a second tensioning arm 59 which is pivotally mounted on a second pivot 61. The second belt 49 is tensioned by the action of a second tension spring 63 on a proximal end of the second tensioning arm 59. The carriage 43 includes a projection 65 which engages with and actuates a sensor switch 67 when the carriage 43 is at the proximal end of the guide bars 45.

Figure 3:
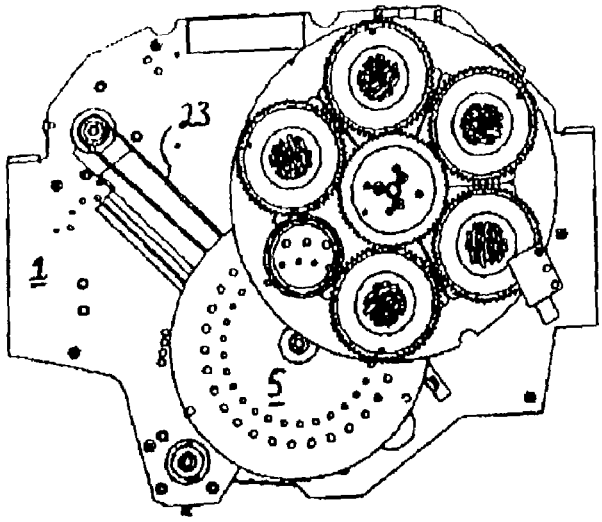
FIGS. 3 to 5 show the embodiment of FIG. 1 in three positions of use.

As shown in FIG. 3, when the carriage 43 is at the distal end of the guide bars 45, the center of the effect wheel 5 is substantially directly vertically below the light path through the aperture 17 of the chassis 1. Consequently, rotation of the effect wheel 5 by means of the rotation motor 27 and the first belt 23 causes the circular pattern 19 to cross the light path in a substantially horizontal direction.

Figure 4:
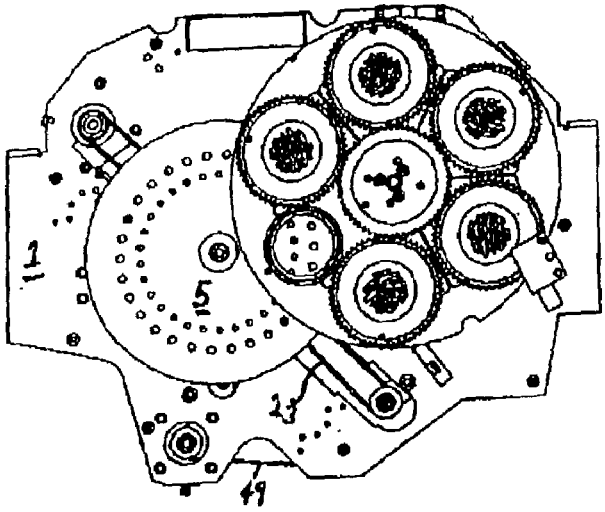

When the effect wheel is moved to the position shown in FIG. 4 (and FIG. 1) by means of the position motor 47 and the second belt 49, the center of the effect wheel 5 is at substantially the same horizontal level as the light path through aperture 17 of the chassis 1. Consequently, rotation of the effect wheel 5 by means of the rotation motor 27 and the first belt 23, causes the circular pattern 19 on the effect wheel 5 to cross the light path in a substantially vertical direction.

By means of the position motor 47, the effect wheel 5 may be moved to a position intermediate the positions shown in FIGS. 3 and 4 to provide movement of the circular pattern 19 through the light path in any direction between the horizontal and the vertical. Furthermore, the linear movement of the effect wheel 5 may be used creatively as part of the effect. For example, the position motor 47 may be actuated cyclically to effect continuous variation of the direction of motion of the circular pattern 19 on the effect wheel 5.

Figure 5:
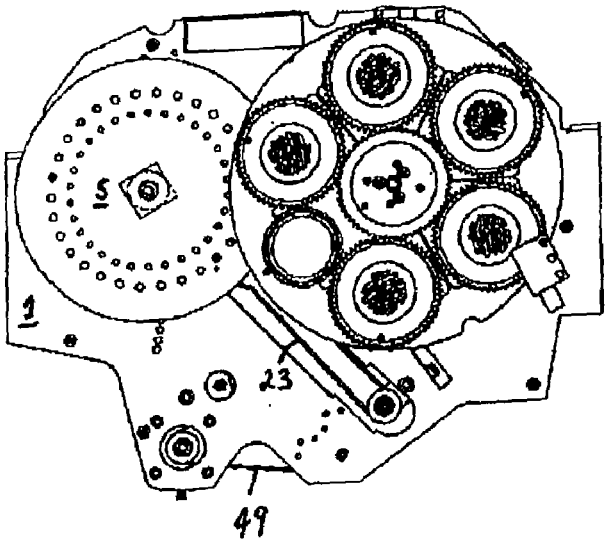

As shown in FIG. 5 (and FIGS. 9 and 10), when the effect wheel 5 is moved to the proximal end of the guide bars 45, the effect wheel 5 no longer intersects the light path through the aperture 17 of the chassis 1. Thus, the effect wheel 5 can reside in this position in a luminaire without affecting the other visual effects which may be used in the luminaire, for example gobo wheel 3, until the continuously rotating wheel effect of the effect wheel 5 is required. When the effect wheel 5 is at the very proximal end of the guide bars 43, the engagement of the projection 65 on the carriage 43 with the sensor switch 67 actuates the sensor switch 67 to provide a confirmatory signal that the effect wheel 5 is outside of the light path for calibration of the position of the carriage 43 on initialization of the apparatus.

In one embodiment, the translation mechanism is arranged to move the effect wheel to a third position in which the effect region intersects the light path and the center of the effect wheel is outside the light path. In the third position, a radius through the light path from the center of the effect wheel is substantially perpendicular to a radius through the light path from the center of the effect wheel in the second position. According to this arrangement, the effect wheel can be moved from the second position to a third position and in doing so the apparent direction of travel of the effect region past the light path is rotated through a right angle (90 degrees). The ability to rotate the direction of travel of the effect region, i.e. a tangent to the center of the effect wheel crossing the light path, while the continuous wheel effect is operating provides creative lighting possibilities which have not previously been available.

Desirably, the translation mechanism is arranged to move the effect wheel to at least one position intermediate the second and third positions. Most desirably, the translation mechanism is arranged to move the effect wheel to any position intermediate the second and third positions. In one arrangement, the first, second and third positions are collinear. The second position may be located between the first and third positions. The translation mechanism may be any suitable mechanism. In general, the translation mechanism includes an electric motor, which allows for electronically controlling the translation of the effect wheel.

In another embodiment, the translation mechanism moves the effect wheel from one position to another position along a circular path. For example, the effect wheel may be mounted on a pivot arm (or wheel) and the electric motor may cause the arm (or wheel) to rotate about an axis in order to move the effect wheel from the one position to another.

The translation mechanism is preferably configured to move the effect wheel linearly from position to position. Thus, the translation mechanism includes a linear guide arrangement and a carriage mounted for linear movement along the guide arrangement. The effect wheel is mounted on the carriage for movement therewith. The guide arrangement includes, for example, one or more guide bars, guide tracks, or guide slots.

In one embodiment, the guide arrangement includes a threaded bar received within a complementary threaded hole in the carriage such that rotation of the threaded bar by the electric motor causes linear movement of the carriage.

In an exemplary embodiment, the carriage is driven along the guide arrangement by a belt element attached to the carriage. The belt element includes belts, chains, strings, and wires.

The rotation mechanism is preferably any suitable mechanism for facilitating the desired movement. In general, the rotation mechanism includes an electric motor, which allows for electrically controlling the rotation of the effect wheel.

In one embodiment, the electric motor is connected directly to the effect wheel. However, in a preferred embodiment the electric motor is fixed relative to the light path and the rotation mechanism comprises a transmission arrangement transmitting the rotational movement of the electric motor to the effect wheel, at least in the second position. The transmission arrangement is preferably arranged to engage the electric motor and/or the effect wheel when the effect wheel is in the second position. However, in the exemplary arrangement, the transmission arrangement is engaged with the electric motor and the effect wheel in the first position and in the second position.

In some embodiments, the transmission arrangement includes a gear train or the like. However, in the exemplary arrangement, the transmission arrangement comprises a belt, as defined herein. In one embodiment, the belt is arranged as a loop between a drive pulley, driven by the electric motor, and a tensioning pulley. A driven pulley engages the belt between the drive pulley and the tensioning pulley and imparts rotational movement to the effect wheel. This arrangement has the advantage that the driven pulley can move linearly along the belt loop while maintaining contact with the belt. Desirably the driven pulley is mounted on the carriage described above.

In one embodiment, the rotation mechanism is configured to engage an edge of the effect wheel to impart rotational movement thereto. However, in a preferred embodiment, the center of the effect wheel is connected to a driven member of the rotation mechanism for rotation therewith. For example, the driven member can be the driven pulley described above.

Desirably, the effect wheel is removable mounted on the rotation mechanism. For example, the effect wheel may be clipped, screwed or otherwise removably attached. In an exemplary arrangement, the effect wheel is magnetically attached to the rotation mechanism. The rotation mechanism preferably includes a locating formation configured to engage with a complementary locating formation on the effect wheel to locate the effect wheel in position on the rotation mechanism. Magnetic attachment of the effect wheel to the rotation mechanism allows the effect wheel to be replaced easily, because the magnetic attraction of the effect wheel to the rotation mechanism tends to pull the effect wheel into position until the locating formations engage. In this way, effect wheels can be exchanged easily in a narrow space in a luminaire. The width of components in a luminaire is kept to a minimum in order to minimize the inertial momentum of the fixture to allow rapid movement.

It will be appreciated from the foregoing that the invention provides a compact and convenient configuration of a continuous wheel effect which can be inserted into a known luminaire, such as the MAC 2000 Profile available from Martin Professional AS. Furthermore, the invention provides the opportunity to produce effects which have not previously been available using a simple continuous rotating wheel.

In summary, lighting apparatus includes an effect wheel which is magnetically mounted on a rotation mechanism. The rotation mechanism is mounted on a translation mechanism which moves the effect wheel from a position outside of the light path to a position in which the effect wheel intersects the light path to provide a continuous wheel effect. The translation mechanism can move the effect wheel between positions in which the effect wheel crosses the light path in a horizontal direction and in a vertical direction, respectively. The apparatus allows a continuous wheel effect to be added to a multi-purpose luminaire and also allows the direction of travel of the continuous wheel effect across the illuminated field to be continuously varied.

Although the present invention was discussed in terms of certain preferred embodiments, the invention is not limited to such embodiments. A person of ordinary skill in the art will appreciate that numerous variations and combinations of the features set forth above can be utilized without departing from the present invention as set forth in the claims. Thus, the scope of the invention should not be limited by the preceding description but should be ascertained by reference to claims that follow.

What is claimed is:

1. A lighting apparatus having a light path defined therethrough, comprising:

an effect wheel having a center and an effect region located radially outwardly of the center, the effect region being configured to alter the visual appearance of a light beam passing therethrough;

a rotation mechanism arranged to rotate the effect wheel about the center; and a translation mechanism arranged to move the effect wheel between a first position in which the effect region is outside of the light path, and a second position in which the effect region intersects the light path and in which the center of the effect wheel is outside the light path (iii) a third position in which the effect region intersects the light path and in which the center of the effect wheel is outside the light path and wherein a radius through the light path from the center of the effect wheel in the third position is substantially perpendicular to a radius through the light path from the center of the effect wheel in the second position.

2. The lighting apparatus of claim 1, wherein the translation mechanism is arranged to move the effect wheel to any position intermediate the second and third positions.

3. The lighting apparatus of claim 1, wherein the first, second and third positions are collinear.

4. The lighting apparatus of claim 1, wherein the translation mechanism is configured to move the effect wheel linearly from one said position to another said position.

5. The lighting apparatus of claim 1, wherein the translation mechanism comprises a linear guide arrangement and a carriage mounted for linear movement along the guide arrangement, and the effect wheel is mounted on the carriage for movement therewith.

6. The lighting apparatus of claim 1, wherein the translation mechanism includes an electric motor.

7. The lighting apparatus of claim 1, wherein the rotation mechanism includes an electric motor.

8. The lighting apparatus of claim 7, wherein the electric motor is fixed relative to the light path and the rotation mechanism comprises a transmission arrangement arranged to transmit rotational movement of the electric motor to the effect wheel.

9. The lighting apparatus of claim 8, wherein the transmission arrangement comprises:

a belt arranged in a loop between a drive pulley driven by the electric motor and a tensioning pulley, wherein a driven pulley engages the belt between the drive pulley and the tensioning pulley and is arranged to impart rotational movement to the effect wheel.

10. The lighting apparatus of claim 1, wherein the center of the effect wheel is connected to a driven member of the rotation mechanism for rotation therewith.

11. The lighting apparatus of claim 1, wherein the effect wheel is removable mounted on the rotation mechanism.

12. The lighting apparatus of claim 4, wherein the effect wheel is magnetically attached to the rotation mechanism.

13. A luminaire comprising the lighting apparatus of claim 1.

14. A lighting apparatus having a light path defined therethrough, comprising:

an effect wheel having a center and an effect region located radially outwardly of the center, the effect region being configured to alter the visual appearance of a light beam passing therethrough the effect region of said effect wheel includes a removable optical component comprising:

an optical portion adapted to alter the visual appearance of a light beam passing therethrough;

a magnetic portion arranged to attach the optical component to a surface of the effect wheel by magnetic attraction; and at least one locating formation configured to engage with a complementary locating formation on said effect wheel to locate the optical component in position on said effect wheel;

a rotation mechanism arranged to rotate the effect wheel about the center; and a translation mechanism arranged to move the effect wheel between a first position in which the effect region is outside of the light path, and a second position in which the effect region intersects the light path and in which the center of the effect wheel is outside the light path.

* * * * *